US008723085B2

(12) United States Patent
Callahan et al.

(10) Patent No.: US 8,723,085 B2
(45) Date of Patent: May 13, 2014

(54) TEMPERATURE CONTROLLED/LIMITING HEATING ELEMENT FOR AN ELECTRIC COOKING APPLIANCE

(75) Inventors: Kevin Callahan, Toronto (CA); Reza Shah, Mississauga (CA); Peter M. Callahan, legal representative, Toronto (CA); Yibing Hu, Mississauga (CA)

(73) Assignee: Pioneering Technology Corp., Mississauga (CA)

( * ) Notice: Subject to any disclaimer, the term of this patent is extended or adjusted under 35 U.S.C. 154(b) by 458 days.

(21) Appl. No.: 12/953,912

(22) Filed: Nov. 24, 2010

(65) Prior Publication Data

US 2012/0125912 A1 May 24, 2012

(51) Int. Cl.
*H05B 1/02* (2006.01)

(52) U.S. Cl.
USPC ... 219/494; 219/505; 219/446.1; 219/448.11; 219/482

(58) Field of Classification Search
CPC ..... H05B 1/02
USPC ..... 219/494, 497, 505, 483, 486, 446.1, 219/448.11, 452.11
See application file for complete search history.

(56) References Cited

U.S. PATENT DOCUMENTS

| | | | | |
|---|---|---|---|---|
| 4,135,081 | A | 1/1979 | Fischer | |
| 4,503,321 | A * | 3/1985 | Schreder | 219/448.11 |
| 4,554,438 | A | 11/1985 | Schreder | |
| 4,605,841 | A | 8/1986 | Fischer et al. | |
| 4,680,452 | A | 7/1987 | Fischer et al. | |
| 4,697,068 | A * | 9/1987 | Schreder | 219/448.19 |
| 4,886,955 | A | 12/1989 | Kimura | |
| 5,029,303 | A | 7/1991 | Kicherer et al. | |
| 5,310,993 | A * | 5/1994 | McWilliams et al. | 219/448.19 |
| 5,796,346 | A | 8/1998 | Wash et al. | |
| 5,994,674 | A * | 11/1999 | Carter | 219/452.11 |
| 6,049,068 | A * | 4/2000 | Logan | 219/453.11 |
| 6,246,033 | B1 | 6/2001 | Shah | |
| 6,717,117 | B2 | 4/2004 | Blanchard et al. | |
| 7,193,192 | B2 | 3/2007 | Lamb | |
| 7,554,060 | B2 | 6/2009 | England et al. | |
| 7,825,353 | B2 * | 11/2010 | Shingler | 219/452.11 |
| 2001/0023868 | A1 | 9/2001 | Aurre et al. | |
| 2006/0027564 | A1 * | 2/2006 | Wilde et al. | 219/492 |
| 2008/0217318 | A1 * | 9/2008 | Azpiritxaga et al. | 219/448.11 |

* cited by examiner

*Primary Examiner* — Mark Paschall
(74) *Attorney, Agent, or Firm* — Norton Rose Fulbright Canada LLP; Paul J. Field

(57) ABSTRACT

A temperature controlled/limiting heating element for an electrically powered cooking appliance, having: a plate with an upper contact heating surface; a pair of heating element terminals adapted for removably engaging electrical power supply terminals of the electrically powered cooking appliance; a plurality of resistive heating wires, in thermal engagement with a lower surface of the top plate, comprising: a non-cycling resistive heating wire connected in series to the heating element terminals; and a cycling resistive heating wire connected in series to the heating element terminals via a thermostat switch in thermal engagement with a lower surface of the top plate, wherein the thermostat switch is normally closed when exposed to a sensed temperature below a set temperature and the thermostat switch opens when the sensed temperature is equal to or exceeds the set temperature.

20 Claims, 4 Drawing Sheets

TEMPERATURE CONTROLLED/LIMITING HEATING ELEMENT FOR AN ELECTRIC COOKING APPLIANCE

TECHNICAL FIELD

The invention relates to a temperature controlled/limiting heating or cooking element for an electrically powered cooking appliance, particularly where the temperature is controlled as a fire prevention measure to be below a flash point or ignition temperature of commonly used cooking oils, grease and common household materials.

BACKGROUND OF THE ART

Cooking of food in residential buildings and homes is a major cause of fires and smoke damage. Of course fires cause significant numbers of preventable deaths, personal injuries as well as property damage. Any means of preventing kitchen fires will be perceived as an important safety advance by individuals, fire departments, insurance companies, health professionals and government agencies.

Restaurant kitchens and large scale food preparation operations are protected by training professional kitchen staff in accident and fire prevention as well as with smoke detectors, fire suppression systems and fire extinguishers.

Homes, student residences, retirement residences and the like where individuals prepare food alone or in an unsupervised non-professional environment are often the scene of kitchen fires due to lack of proper attention, oil spills, grease build-up, carelessness, forgetfulness, and lack of awareness of safe cooking procedures. For example, fire statistics indicate that in North America the cause of over 40% of residential fires is related to cooking.

Electric stoves and heating elements in particular cause kitchen fires because the temperature of the hot surface exceeds the flash point or ignition temperature of many foods, paper, cloth and building materials that may come into contact with the hot surface. U.S. Pat. No. 6,246,033 to Shah provides a temperature controlled electric heating element. However, due to the complexity of the internal stove circuit modifications required, installation must be carried out by the original equipment manufacturer (OEM) or by a licensed electrician.

Although electric stoves are being produced with a single glass cook top having multiple burners in a single unit, the electric stoves with individual elements are still popular due to lower cost and ease of maintenance. For example, in a rental apartment, damage to a single burner is relatively cheap and easy to repair by simply exchanging the faulty element with a new element. However replacing the entire multiple burner glass cook top is almost as expensive as purchasing a new stove. The fragile nature of glass ceramic cook tops makes such stoves unsuitable for many rental or public housing residences where care and attention to appliances is often lacking, low cost and durability is a major concern.

Accordingly it is desirable to provide a temperature controlled or limiting electric heating element that reduces fire risk and is simple to install by unskilled labour, inexpensive to manufacture, durable and can be retrofit to existing appliances.

Features that distinguish the present invention from the background art will be apparent from review of the disclosure, drawings and description of the invention presented below.

SUMMARY OF THE INVENTION

The invention provides a temperature controlled heating element for an electrically powered cooking appliance, having: a plate with an upper contact heating surface; a pair of heating element terminals adapted for removably engaging electrical power supply terminals of the electrically powered cooking appliance; a plurality of resistive heating wires, in thermal engagement with a lower surface of the top plate, comprising: a non-cycling resistive heating wire connected in series to the heating element terminals; and a cycling resistive heating wire connected in series to the heating element terminals via a thermostat switch in thermal engagement with a lower surface of the top plate, wherein the thermostat switch is normally closed when exposed to a sensed temperature below a set temperature and the thermostat switch opens when the sensed temperature is equal to or exceeds the set temperature.

The temperature controlled heating element reduces the risk of fire by maintaining the set temperature below the ignition temperature or flash point of common cooking oils, paper and cloth for example that are often the initial cause of flames when contacting a hot element.

Conventional electric stove elements when fully powered can be up to 600° C. so that the electric element can quickly heat a pot and contents thereby speeding up the cooking process. However once the element and pot are initially brought up to a cooking temperature, the amount of energy required to maintain the cooking temperature is reduced, and an attentive cook will turn the heat down to avoid burning the food, to avoid unsafe boiling of liquids, and unsafe overheating of oil that may ignite.

Unfortunately, despite the best efforts of fire safety educators, kitchen fires still occur due to negligence, ignorance, lack of attention or forgetfulness. The invention provides a temperature controlled heating element for an electric cooking appliance that can reduce the risk of fire since the temperature of the element is restricted to a lower temperature than conventional elements. Further the heating element may be configured as a single burner element so that existing electric stoves may be repaired or retrofit with a temperature controlled element by unskilled labour. Changing a stove element is similar to changing a light bulb and does not require circuit modifications or the skill of a trained electrician.

DESCRIPTION OF THE DRAWINGS

In order that the invention may be readily understood, an embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
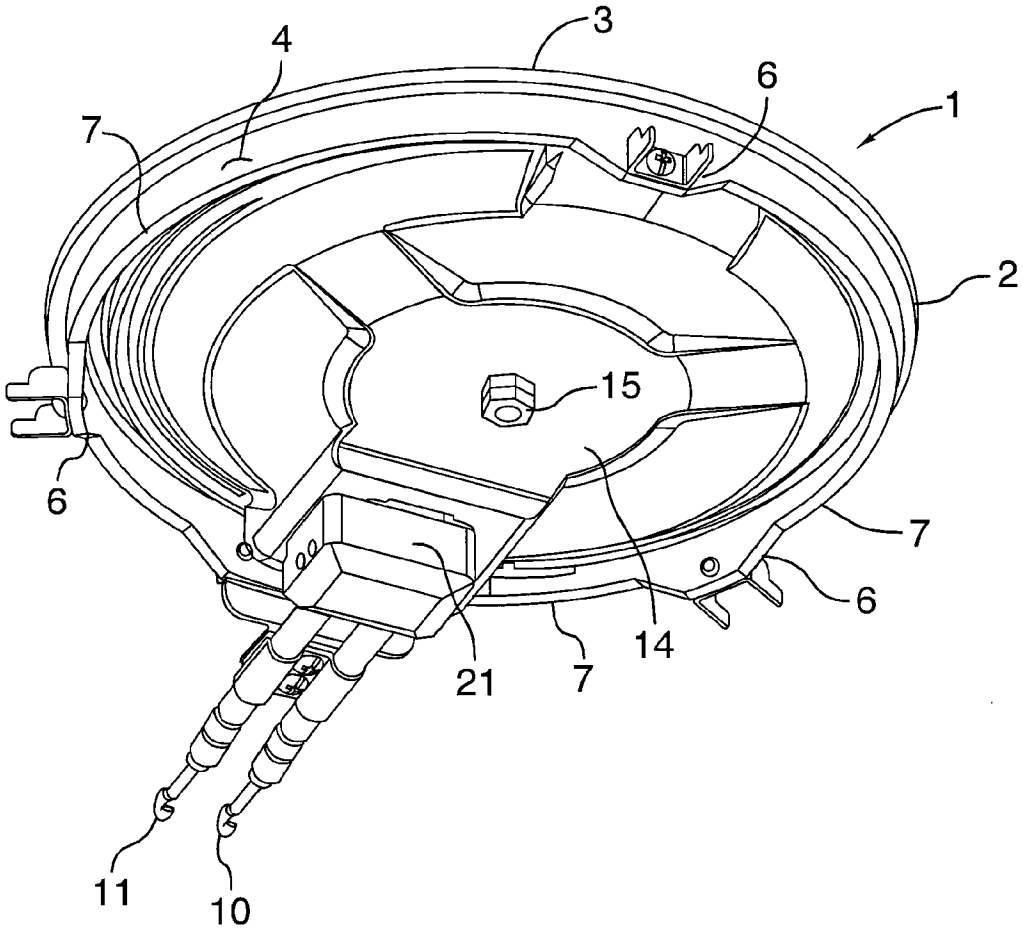
FIG. 1 is a perspective view of the underside of a temperature controlled heating element.
Figure 2:
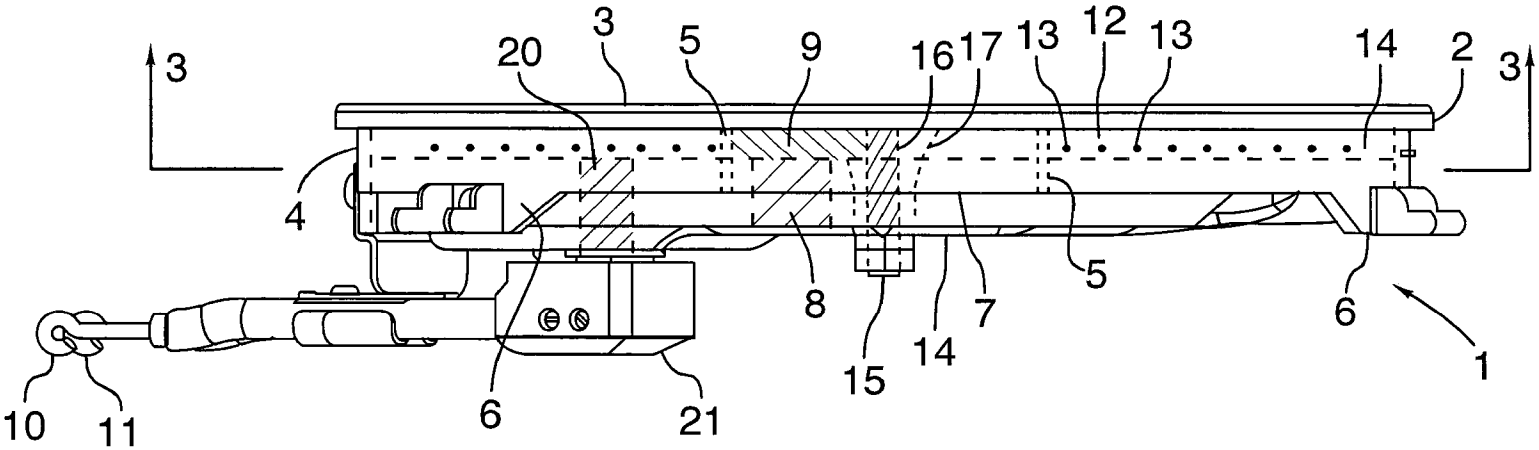
FIG. 2 is a side view of the element of FIG. 1 showing the internal structure in ghost outline.

FIG. 1 shows the underside of a temperature controlled heating element 1 for an electrically powered cooking appliance such as an electric stove, hot plate or stove top. FIG. 2 shows a side view with internal components in ghost outline. The element 1 has a metal top plate 2 with an upper contact heating surface 3. The plate 2 serves to absorb heat from the electrical resistive heating wires and transfer heat through contact with a pot or pan that is placed on the upper contact heating surface 3.

Figure 3:
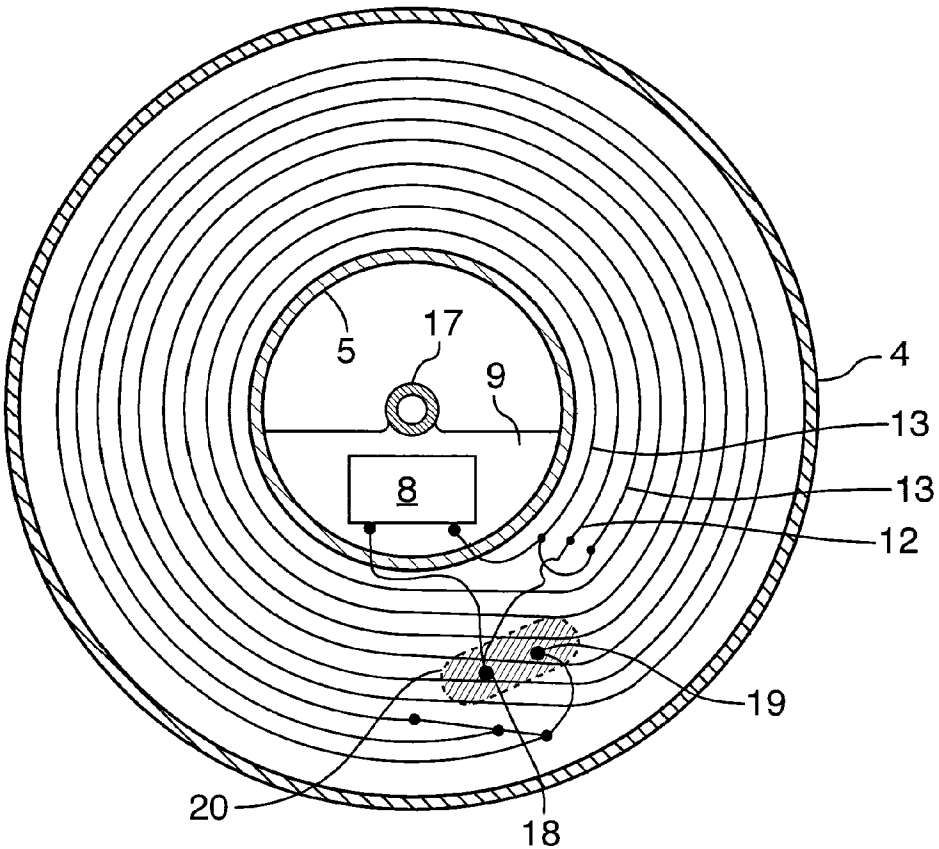
FIG. 3 is a sectional view along line 3-3 of FIG. 2.

As best seen in FIGS. 2-3, the plate 2 has an outer peripheral wall 4 and an inner wall 5. The plate 2, and walls 4-5 may be cast of metal formed from sintering a cast metal powder. The outer wall 4 has mounting tabs 6 (see FIGS. 1-2) for installing in a conventional recess of a stove. Between the mounting tabs 6 are hot air vent notches 7 to allow hot air to escape and vent from the stove.

As seen in FIGS. 2-3, the inner wall 5 of the plate 2 defines a central chamber in which the thermostat switch 8 is housed. The plate 2 has a generally uniform thickness but includes a platform 9 on which the thermostat 8 is mounted that has a greater thickness to serve as a heat sink or heat absorbing portion to enhance the reliability of heat sensing by the thermostat switch 8.

Figure 4:
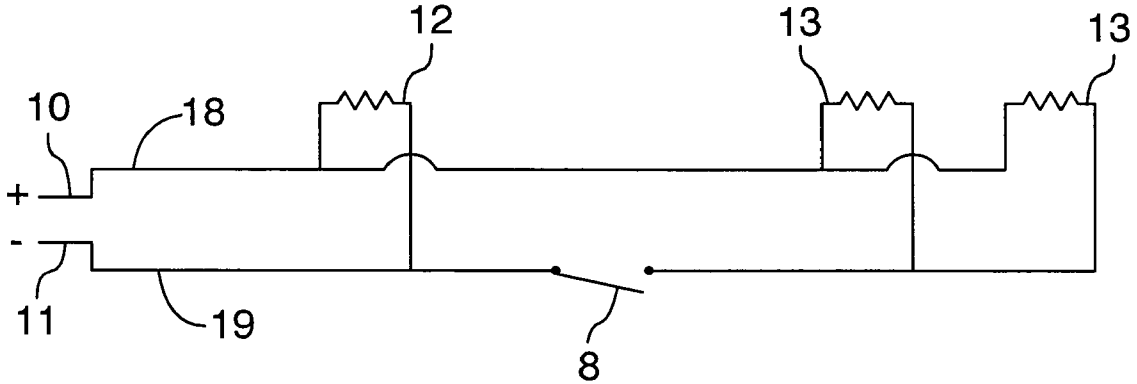
FIG. 4 is a schematic circuit diagram of the electric components of the temperature controlled heating element.

As seen in FIGS. 1-2, the element 1 has a pair of heating element terminals 10-11 adapted for removably engaging electrical power supply terminals (not shown) of the electrically powered cooking appliance (not shown). FIG. 4 shows the electrical circuit schematically where electric power from the terminals 10-11 is conducted to three resistive heating wires 12-13 that are disposed between the outer wall 4 and the inner wall 5 in thermal engagement with a lower surface of the top plate 2, as seen in FIGS. 2-3. The resistive heating wires 12-13 are embedded within a refractory layer 14 formed of a wet castable refractory composition to protect the wires 12-13, hold them in place and to enhance heat distribution to the plate 2.

The non-cycling resistive heating wire 12 is connected in series to the heating element terminals 10-11 and remains energized at all times that the terminals 10-11 are energized by the stove. The non-cycling wire 12 provides a basic amount of heat to maintain the plate 2 at a relatively low temperature and reduces the frequency of cycling on-off by the two cycling resistive heating wires 13. The cycling resistive heating wires 13 are connected in series to the heating element terminals 10-11 via the normally closed thermostat switch 8 that is in thermal engagement with the lower surface of the top plate 2.

The thermostat switch 8 is normally closed when exposed to a sensed temperature below a set temperature and the thermostat switch 8 opens when the sensed temperature is equal to or exceeds the set temperature. For example the set temperature can be established at a temperature anywhere between 370° F. and 450° F., such as 400-420° F. to maintain the contact surface 3 below the ignition temperature of common cooking oil, which is a frequent cause of serious kitchen fires.

The thermostat switch 8 can be for example Z03 High Temperature Thermostat produced by Zertan SA of Navarra, Spain that has a nominal current load capacity of 10 Amps at 250 Volts AC and a duty life of no less than 10,000 cycles, which has been found to be suitable and provides an acceptable 7-10 year life expectancy.

The temperature controlled heating element 1 illustrated has two cycling resistive heating wires 13 and a single non-cycling resistive heating wire 12. However any number of cycling and non-cycling heating wires 12-13 could be provided depending on the application.

The cycling resistive heating wires 13 are configured in a series circuit shown in FIG. 4 and having a current resistance in the range of 4 to 8 Amps at 250 Volts AC, and preferably 5 to 7 Amps at 250 Volts AC. the length of wires 12-13 are adjusted to accurately establish the current resistance approximately equal to or less than the nominal load capacity of the thermostat switch 8, namely 10 Amps at 250 VAC. It has been found that the thermostat switch 8 is very sensitive to excessive current and that the operating life span of the thermostat switch 8 is significantly reduced if the nominal current of 10 Amps at 250 VAC is exceeded. Therefore establishing the length of the heating wires 12-13 accurately will establish the resistance and optimize the life span of the thermostat 8.

As seen in FIGS. 1-2, a protective cover 14 is disposed inward of the outer wall 4 and beneath the heating wires 12-13 and thermostat switch 8. The cover 14 is mounted to the plate 2 with a fastener nut 15 and threaded shaft 16 extending through the cover 14 from a central boss 17 with a threaded bore.

A pair of terminal wires 18-19 pass through the cover 14. An inner insulative ceramic block 20 is disposed between the plate 2 and the cover 14, and the inner ceramic block 20 surrounds the pair of terminal wires 18-19.

An outer insulative ceramic block 21 is disposed beneath the cover 14 and engages the inner ceramic block 20. The outer insulative ceramic block 21 has a pair of connectors engaging end portions of the pair of terminal wires 18-19 extending downward from the inner block 20. In this manner the metal cover 14 is electrically isolated from the electrical circuit and the ceramic blocks 20-21 impede heat transfer between the heating wires 12-13 and the cover 14.

We claim:

1. A temperature limiting heating element for an electrically powered cooking appliance, comprising:

a plate with an upper contact heating surface;

a pair of heating element terminals adapted for removably engaging electrical power supply terminals of the electrically powered cooking appliance;

a plurality of resistive heating wires, in thermal engagement with a lower surface of the top plate, comprising:

a continuously operative resistive heating wire connected in series to the heating element terminals; and a cycling resistive heating wire connected in series to the heating element terminals via a temperature limiting control switch in thermal engagement with a lower surface of the top plate, wherein the temperature limiting control switch is normally closed when exposed to a sensed temperature below a set temperature and the temperature limiting control switch opens when the sensed temperature is equal to or exceeds the set temperature.

2. The temperature limiting heating element of claim 1 wherein the set temperature is in the range of 370° C. to 450° C.

3. The temperature limiting heating element of claim 2 wherein the set temperature is in the range of 370° C. to 390° C.

4. The temperature limiting heating element of claim 1 wherein the temperature limiting control switch has a nominal current load capacity of 10 Amps at 250 Volts AC.

5. The temperature limiting heating element of claim 4 wherein the temperature limiting control switch has a duty life of no less than 10,000 cycles.

6. The temperature limiting heating element of claim 1 comprising at least two cycling resistive heating wires.

7. The temperature limiting heating element of claim 1, wherein the plate includes an outer peripheral wall.

8. The temperature limiting heating element of claim 7, wherein the plate includes an inner wall defining a chamber in which the temperature limiting control switch is housed.

9. The temperature controlled heating element of claim 8 wherein, the continuously operative resistive heating wires and the cycling resistive heating wires are disposed between the inner and outer walls.

10. The temperature limiting heating element of claim 9 wherein, the continuously operative resistive heating wires and the cycling resistive heating wires are embedded within a refractory layer.

11. The temperature limiting heating element of claim 10 wherein the refractory layer is formed from a wet castable refractory composition.

12. The temperature limiting heating element of claim 4 wherein the cycling resistive heating wires are configured in a series circuit having a resistance in the range of 4 to 8 Amps at 250 Volts AC.

13. The temperature limiting heating element of claim 12 wherein the cycling resistive heating wires are configured in the series circuit having a resistance in the range of 5 to 7 Amps at 250 Volts AC.

14. The temperature limiting heating element of claim 8 wherein the plate has a plate thickness and includes a platform on which the temperature limiting control switch is mounted with a platform thickness greater than the plate thickness.

15. The temperature limiting heating element of claim 7 comprising a cover disposed: inward of the outer wall; and beneath the wires and temperature limiting control switch, the cover being mounted to the plate with a fastener.

16. The temperature limiting heating element of claim 15 wherein the plate includes a central boss with a threaded bore and the fastener comprises a threaded shaft passing through the cover.

17. The temperature limiting heating element of claim 15 wherein the pair of heating element terminals include:

a pair of terminal wires in electrical communication with the temperature limiting control switch, the continuously operative resistive heating wire and the cycling resistive heating wire, the pair of terminal wires passing through the cover;

an inner insulative ceramic block disposed between the plate and the cover, the inner ceramic bloc surrounding the pair of terminal wires; and an outer insulative ceramic block disposed beneath the cover and engaging the inner ceramic bloc, the outer insulative ceramic block having a pair of connectors engaging end portions of the pair of terminal wires extending downward from the inner block.

18. The temperature limiting heating element of claim 1 wherein the plate is formed of sintered cast metal powder.

19. The temperature limiting heating element of claim 7 wherein the outer wall includes mounting tabs.

20. The temperature limiting heating element of claim 4 wherein the outer wall includes hot air vent notches between the mounting tabs.

* * * * *